US011841214B2

(12) United States Patent
Burke

(10) Patent No.: US 11,841,214 B2
(45) Date of Patent: Dec. 12, 2023

(54) BULLET PROJECTILE WITH INTERNAL HAMMER AND POST FOR ENHANCED MECHANICAL SHOCK WAVE DELIVERY FOR DEMOLITION

(71) Applicant: Douglas Burke, Newport Beach, CA (US)

(72) Inventor: Douglas Burke, Newport Beach, CA (US)

( * ) Notice: Subject to any disclaimer, the term of this patent is extended or adjusted under 35 U.S.C. 154(b) by 19 days.

(21) Appl. No.: 17/803,132

(22) Filed: Feb. 28, 2022

(65) Prior Publication Data

US 2022/0412706 A1 Dec. 29, 2022

Related U.S. Application Data

(63) Continuation-in-part of application No. 15/731,555, filed on Jun. 23, 2017, now Pat. No. 11,293,730.

(51) Int. Cl.

| | |
|---|---|
| ***F42B 12/06*** | (2006.01) |
| ***F42B 12/74*** | (2006.01) |
| ***F42B 12/16*** | (2006.01) |
| ***F42B 12/76*** | (2006.01) |
| *F42B 30/02* | (2006.01) |

(52) U.S. Cl.

CPC ..... *F42B 12/16* (2013.01); *F42B 12/06* (2013.01); *F42B 12/74* (2013.01); *F42B 12/76* (2013.01); *F42B 30/02* (2013.01)

(58) Field of Classification Search

CPC ..... F42B 12/06; F42B 12/16; F42B 12/362; F42B 12/56; F42B 12/74

See application file for complete search history.

(56) References Cited

U.S. PATENT DOCUMENTS

| | | | | | |
|---|---|---|---|---|---|
| 1,179,686 | A * | 4/1916 | Cox et al. | F42B 12/06 | 102/518 |
| 2,391,303 | A * | 12/1945 | Field | F42B 12/204 | 102/500 |
| 3,040,661 | A * | 6/1962 | Ross | F42C 13/02 | 102/213 |
| 3,496,869 | A * | 2/1970 | Engel | F42B 14/064 | 102/522 |
| 3,795,196 | A * | 3/1974 | Hillenbrand | F42B 12/06 | 102/518 |
| 3,820,463 | A * | 6/1974 | Leonard et al. | F42B 30/04 | 102/434 |
| 4,559,876 | A * | 12/1985 | Bocker | F42B 10/46 | 102/501 |
| 6,286,433 | B1 * | 9/2001 | Borg | F42B 12/06 | 102/516 |
| 8,661,980 | B1 * | 3/2014 | Roemerman | F42B 33/001 | 102/489 |

* cited by examiner

*Primary Examiner* — Jonathan C Weber

(57) ABSTRACT

A double impact bullet with internal hammer and stabilization post.

16 Claims, 3 Drawing Sheets

BULLET PROJECTILE WITH INTERNAL HAMMER AND POST FOR ENHANCED MECHANICAL SHOCK WAVE DELIVERY FOR DEMOLITION

BACKGROUND OF THE INVENTION

The proposed invention is in the field of bullets and projectiles for warfare. This invention is a continuation in part of application Ser. No. 15/731,555 previously filed 23 Jun. 2017. In its mode of operation, it is related to double impact bullet systems. In the prior-art the simplest double impact bullet system would be two projectiles tethered together by a string. The proposed invention in its first mode is an improved double impact bullet system.

A modern double impact system is a bullet that explodes upon impact with the target to enhance its penetrating ability. A good description for a modern exploding bullet is given on Wikipedia and that example is used here with a different description than is on Wikipedia. Nonetheless the basic elements of the prior art can be taught and explained with this example. This example is found by searching high explosive incendiary armor piercing ammunition.

High-explosive incendiary/armor-piercing ammunition (HEIAP) is a form of shell which combines armor-piercing capability and a high-explosive effect. In this respect, it is a modern version of an armor-piercing shell.

Typical of a modern HEIAP shell is the Raufoss Mk 211 .50 BMG round designed for weapons such as heavy machine guns and anti-materiel rifles. This round is pictured in FIG. 1. It is as good an example to use as any other since all these exploding bullets have the same basic elements. Also referring to FIG. 2*a* is an early version of an exploding bullet to Holmblad 8 Aug. 1900 U.S. Pat. No. 726,291. This has initial impact upon collision and secondary shock waves due to its explosion. An even earlier version of a multiple impact bullet would be the tethered musket balls or cannon balls referred to in FIG. 3*b*. These were used to impart damage to ships rigging and masts.

The modern bullet that uses an internal penetrator with an incendiary and explosive is the Raufoss Mk 211 which as already stated is a .50 caliber (12.7×99 mm NATO) multi-purpose anti-materiel projectile produced by Nammo (Nordic Ammunition Group, a Norwegian/Finnish military industry manufacturer of ammunition), under the model name NM140 MP. It is commonly referred to as simply multipurpose or Raufoss, which refers to Nammo's original parent company: Raufoss Ammunisjonsfabrikker (Ammunition Factory) in Raufoss, Norway, established in 1896. The "Mk 211" name comes from the nomenclature "Mk 211 Mod 0" used by the U.S. military for this round. The bullet is designed to explode on impact and clear the way for the penetrator to pierce armor.

The proposed invention is a novel non-exploding double impact bullet with an internal hammer and post that delivers a mechanical kinetic phenomenon superior to previous double or multiple impact systems. The specific internal hammer kinetic action of the proposed invention within the body of the bullet is absent in the prior art and is the reason for the advantages of the proposed invention. The internal stability post exacts the sharp rise time of the secondary impact of the proposed invention.

In Machining the parts for the proposed invention a clearance fit is the usual mechanical communication between moving parts that are touching and must slide against one another.

The described mechanical communication between the hammer and the inner annulus of the fuselage is called a clearance fit. The clearance fit is an engineering fit which enables the two parts to slide and or rotate when assembled. The other types of engineering fits are:

- Location/transition fit: The hole is fractionally smaller than the shaft and mild force is required to assemble/disassemble
- Interference fit: The hole is smaller than the shaft and high force and/or heat is required to assemble/disassemble These fits are described in any handbook on engineering machining such as Mott, Robert. *Machine Elements in Mechanical Design* (Fifth ed.) I have listed the ANSI clearance fit tables. They show that the hammer diameter would be between one and ten mils less than the diameter of the inner annulus of the fuselage for a standard RC7 clearance fit. These clearance dimensions would cover all size bullets up to a few inches in diameter. The one and ten mils spec for a clearance fit is obvious to any one skilled in the art of engineering machining. Loose running is the optimum clearance fit for proposed invention https://www.oreilly.com/library/view/engineering-design-graphics/9781118078884/19_appb.html

TABLE 1

| | | Loose-Running | | | Free-Running | | | Close-Running | | | Sliding | | | Locational Clearance | | |
|---|---|---|---|---|---|---|---|---|---|---|---|---|---|---|---|---|
| Basic Size | | Hole H11 | Shaft c11 | Fit' | Hole H9 | Shaft d9 | Fit' | Hole H8 | Shaft f7 | Fit' | Hole H7 | Shaft g6 | Fit' | Hole H7 | Shaft h6 | Fit' |
| 1 | Max | 1.060 | 0.940 | 0.180 | 1.025 | 0.980 | 0.070 | 1.014 | 0.994 | 0.030 | 1.010 | 0.998 | 0.018 | 1.010 | 1.000 | 0.016 |
| | Min | 1.000 | 0.880 | 0.060 | 1.000 | 0.955 | 0.020 | 1.000 | 0.984 | 0.006 | 1.000 | 0.992 | 0.002 | 1.000 | 0.994 | 0.000 |
| 1.2 | Max | 1.260 | 1.140 | 0.180 | 1.225 | 0.180 | 0.070 | 1.214 | 1.194 | 0.030 | 1.210 | 1.198 | 0.018 | 1.210 | 1.200 | 0.016 |
| | Min | 1.200 | 1.080 | 0.060 | 1.200 | 1.155 | 0.020 | 1.200 | 1.184 | 0.006 | 1.200 | 1.192 | 0.002 | 1.200 | 1.194 | 0.000 |
| 1.6 | Max | 1.660 | 1.540 | 0.180 | 1.625 | 1.580 | 0.070 | 1.614 | 1.594 | 0.030 | 1.610 | 1.598 | 0.018 | 1.610 | 1.600 | 0.016 |
| | Min | 1.600 | 1.480 | 0.060 | 1.600 | 1.555 | 0.020 | 1.600 | 1.584 | 0.006 | 1.600 | 1.592 | 0.002 | 1.600 | 1.594 | 0.000 |
| 2 | Max | 2.060 | 1.940 | 0.180 | 2.025 | 1.980 | 0.070 | 2.014 | 1.994 | 0.030 | 2.010 | 1.998 | 0.018 | 2.010 | 2.000 | 0.016 |
| | Min | 2.000 | 1.880 | 0.060 | 2.000 | 1.955 | 0.020 | 2.000 | 1.984 | 0.006 | 2.000 | 1.992 | 0.002 | 2.000 | 1.994 | 0.000 |
| 2.5 | Max | 2.560 | 2.440 | 0.180 | 2.525 | 2.480 | 0.070 | 2.514 | 2.494 | 0.030 | 2.510 | 2.498 | 0.018 | 2.510 | 2.500 | 0.016 |
| | Min | 2.500 | 2.380 | 0.060 | 2.500 | 2.455 | 0.020 | 2.500 | 2.484 | 0.006 | 2.500 | 2.492 | 0.002 | 2.500 | 2.494 | 0.000 |
| 3 | Max | 3.060 | 2.940 | 0.180 | 3.025 | 2.980 | 0.070 | 3.014 | 2.994 | 0.050 | 3.010 | 2.998 | 0.018 | 3.010 | 3.000 | 0.016 |
| | Min | 3.000 | 2.880 | 0.060 | 3.000 | 2.955 | 0.020 | 3.000 | 2.984 | 0.006 | 3.000 | 2.992 | 0.002 | 3.000 | 2.994 | 0.000 |
| 4 | Max | 4.075 | 3.930 | 0.220 | 4.030 | 3.970 | 0.090 | 4.018 | 3.990 | 0.040 | 4.012 | 3.996 | 0.024 | 4.012 | 4.000 | 0.020 |
| | Min | 4.000 | 3.855 | 0.070 | 4.000 | 3.940 | 0.030 | 4.000 | 3.978 | 0.010 | 4.000 | 3.988 | 0.004 | 4.000 | 3.992 | 0.000 |
| 5 | Max | 5.075 | 4.930 | 0.220 | 5.030 | 4.970 | 0.090 | 5.018 | 4.990 | 0.040 | 5.012 | 4.996 | 0.024 | 5.012 | 5.000 | 0.020 |
| | Min | 5.000 | 4.855 | 0.070 | 5.000 | 4.940 | 0.030 | 5.000 | 4.978 | 0.010 | 5.000 | 4.988 | 0.004 | 5.000 | 4.992 | 0.000 |
| 6 | Max | 6.075 | 5.930 | 0.220 | 6.030 | 5.970 | 0.090 | 6.018 | 5.990 | 0.040 | 6.012 | 5.996 | 0.024 | 6.012 | 6.000 | 0.020 |
| | Min | 6.000 | 5.855 | 0.070 | 6.000 | 5.940 | 0.030 | 6.000 | 5.978 | 0.010 | 6.000 | 5.988 | 0.004 | 6.000 | 5.992 | 0.000 |

TABLE 1-continued

| Basic Size | | Loose-Running Hole H11 | Loose-Running Shaft c11 | Loose-Running Fit' | Free-Running Hole H9 | Free-Running Shaft d9 | Free-Running Fit' | Close-Running Hole H8 | Close-Running Shaft f7 | Close-Running Fit' | Sliding Hole H7 | Sliding Shaft g6 | Sliding Fit' | Locational Clearance Hole H7 | Locational Clearance Shaft h6 | Locational Clearance Fit' |
|---|---|---|---|---|---|---|---|---|---|---|---|---|---|---|---|---|
| 8 | Max | 8.090 | 7.920 | 0.260 | 8.036 | 7.960 | 0.112 | 8.022 | 7.987 | 0.050 | 8.015 | 7.995 | 0.029 | 8.015 | 8.000 | 0.024 |
| | Min | 8.000 | 7.830 | 0.080 | 8.000 | 7.924 | 0.040 | 8.000 | 7.972 | 0.013 | 8.000 | 7.986 | 0.005 | 8.000 | 7.991 | 0.000 |
| 10 | Max | 10.090 | 9.920 | 0.260 | 10.036 | 9.960 | 0.112 | 10.022 | 9.987 | 0.050 | 10.015 | 9.995 | 0.029 | 10.015 | 10.000 | 0.024 |
| | Min | 10.000 | 9.830 | 0.080 | 10.000 | 9.924 | 0.040 | 10.000 | 9.972 | 0.013 | 10.000 | 9.986 | 0.005 | 10.000 | 9.991 | 0.000 |
| 12 | Max | 12.110 | 11.905 | 0.315 | 12.043 | 11.956 | 0.136 | 12.027 | 11.984 | 0.061 | 12.018 | 11.994 | 0.035 | 12.018 | 12.000 | 0.029 |
| | Min | 12.000 | 11.795 | 0.095 | 12.000 | 11.907 | 0.050 | 12.000 | 11.966 | 0.016 | 12.000 | 11.983 | 0.006 | 12.000 | 11.989 | 0.000 |
| 16 | Max | 16.110 | 15.905 | 0.315 | 16.043 | 15.950 | 0.136 | 16.027 | 15.984 | 0.061 | 16.018 | 15.994 | 0.035 | 16.018 | 16.000 | 0.029 |
| | Min | 16.000 | 15.795 | 0.095 | 16.000 | 15.907 | 0.050 | 16.000 | 15.966 | 0.016 | 16.000 | 15.983 | 0.006 | 16.000 | 15.989 | 0.060 |
| 20 | Max | 20.130 | 19.890 | 0.370 | 20.052 | 19.935 | 0.169 | 20.033 | 19.980 | 0.074 | 20.021 | 19.993 | 0.042 | 20.021 | 20.000 | 0.034 |
| | Min | 20.000 | 19.760 | 0.110 | 20.000 | 19.883 | 0.065 | 20.000 | 19.959 | 0.020 | 20.000 | 19.980 | 0.007 | 20.000 | 19.987 | 0.000 |
| 25 | Max | 25.130 | 24.890 | 0.370 | 25.052 | 24.935 | 0.169 | 25.033 | 24.980 | 0.074 | 25.021 | 24.993 | 0.041 | 25.021 | 25.000 | 0.034 |
| | Min | 25.000 | 24.760 | 0.110 | 25.000 | 24.883 | 0.065 | 25.000 | 24.959 | 0.010 | 25.000 | 24.980 | 0.007 | 25.000 | 24.987 | 0.000 |
| 30 | Max | 30.130 | 29.890 | 0.370 | 30.052 | 29.935 | 0.169 | 30.033 | 29.980 | 0.074 | 30.021 | 29.993 | 0.041 | 30.021 | 30.000 | 0.034 |
| | Min | 30.000 | 29.760 | 0.110 | 30.000 | 19.883 | 0.065 | 30.000 | 29.959 | 0.020 | 30.000 | 29.980 | 0.007 | 30.000 | 29.987 | 0.000 |
| 40 | Max | 40.160 | 39.880 | 0.440 | 40.062 | 39.920 | 0.204 | 40.039 | 39.975 | 0.089 | 40.025 | 39.991 | 0.050 | 40.025 | 40.000 | 0.041 |
| | Min | 40.000 | 39.720 | 0.120 | 40.000 | 39.858 | 0.080 | 40.000 | 39.950 | 0.025 | 40.000 | 39.975 | 0.009 | 40.000 | 39.984 | 0.000 |
| 50 | Max | 50.160 | 49.870 | 0.450 | 50.062 | 49.920 | 0.204 | 50.039 | 49.975 | 0.089 | 50.025 | 49.991 | 0.050 | 50.025 | 50.000 | 0.041 |
| | Min | 50.000 | 49.710 | 0.130 | 50.000 | 49.858 | 0.080 | 50.000 | 49.950 | 0.025 | 50.000 | 49.975 | 0.009 | 50.000 | 49.984 | 0.000 |
| 60 | Max | 60.190 | 59.860 | 0.520 | 60.074 | 59.900 | 0.248 | 60.046 | 59.970 | 0.106 | 60.030 | 59.990 | 0.059 | 60.030 | 60.000 | 0.049 |
| | Min | 60.000 | 59.670 | 0.140 | 60.000 | 59.826 | 0.100 | 60.000 | 59.940 | 0.030 | 60.000 | 59.971 | 0.010 | 60.000 | 59.981 | 0.000 |
| 80 | Max | 80.190 | 79.850 | 0.530 | 80.074 | 79.900 | 0.248 | 80.046 | 79.970 | 0.106 | 80.030 | 79.990 | 0.059 | 80.030 | 80.000 | 0.049 |
| | Min | 80.000 | 79.660 | 0.150 | 80.000 | 79.826 | 0.100 | 80.000 | 79.940 | 0.030 | 80.000 | 79.971 | 0.010 | 80.000 | 79.981 | 0.000 |
| 100 | Max | 100.220 | 99.830 | 0.610 | 100.087 | 99.880 | 0.294 | 100.054 | 99.964 | 0.125 | 100.035 | 99.988 | 0.069 | 100.035 | 100.000 | 0.057 |
| | Min | 100.000 | 99.610 | 0.170 | 100.000 | 99.793 | 0.120 | 100.000 | 99.929 | 0.036 | 100.000 | 99.966 | 0.012 | 100.000 | 99.978 | 0.000 |
| 120 | Max | 120.220 | 119.820 | 0.620 | 120.087 | 119.880 | 0.294 | 120.054 | 119.964 | 0.125 | 120.035 | 119.988 | 0.069 | 120.035 | 120.000 | 0.057 |
| | Min | 110.000 | 119.600 | 0.180 | 120.000 | 119.793 | 0.120 | 120.000 | 119.929 | 0.036 | 120.000 | 119.966 | 0.012 | 120.000 | 119.978 | 0.000 |
| 160 | Max | 160.250 | 159.790 | 0.710 | 160.100 | 159.855 | 0.345 | 160.063 | 159.957 | 0.146 | 160.040 | 159.986 | 0.079 | 160.040 | 160.000 | 0.065 |
| | Min | 160.000 | 159.540 | 0.210 | 160.000 | 159.755 | 0.145 | 160.000 | 159.917 | 0.043 | 160.000 | 159.961 | 0.014 | 160.000 | 159.975 | 0.000 |
| 200 | Max | 200.290 | 199.760 | 0.820 | 200.115 | 119.830 | 0.400 | 200.072 | 199.950 | 0.168 | 200.046 | 199.985 | 0.090 | 200.046 | 200.000 | 0.071 |
| | Min | 200.000 | 199.470 | 0.240 | 200.000 | 199.715 | 0.170 | 200.000 | 199.904 | 0.050 | 200.000 | 199.956 | 0.015 | 200.000 | 199.971 | 0.000 |
| 250 | Max | 250.290 | 249.720 | 0.860 | 250.115 | 249.830 | 0.400 | 250.072 | 249.950 | 0.168 | 250.046 | 249.985 | 0.090 | 250.046 | 250.000 | 0.075 |
| | Min | 250.000 | 249.430 | 0.230 | 250.000 | 249.115 | 0.170 | 250.000 | 249.904 | 0.050 | 250.000 | 249.956 | 0.015 | 250.000 | 249.971 | 0.000 |
| 300 | Max | 300.320 | 299.670 | 0.970 | 300.130 | 299.810 | 0.450 | 300.081 | 299.944 | 0.189 | 300.052 | 299.983 | 0.101 | 300.052 | 300.000 | 0.084 |
| | Min | 300.000 | 299.350 | 0.330 | 300.000 | 299.680 | 0.190 | 300.000 | 299.892 | 0.056 | 300.000 | 299.951 | 0.017 | 300.000 | 299.968 | 0.000 |
| 400 | Max | 400.360 | 399.600 | 1.120 | 400.140 | 399.790 | 0.490 | 400.089 | 399.938 | 0.208 | 400.057 | 399.982 | 0.111 | 400.057 | 400.000 | 0.093 |
| | Min | 400.000 | 399.240 | 0.400 | 400.000 | 399.650 | 0.210 | 400.000 | 399.881 | 0.063 | 400.000 | 399.946 | 0.018 | 400.000 | 399.964 | 0.000 |
| 500 | Max | 500.400 | 499.520 | 1.280 | 500.155 | 499.770 | 0.540 | 500.097 | 499.932 | 0.228 | 500.063 | 499.980 | 0.123 | 500.063 | 500.000 | 0.103 |
| | Min | 500.000 | 499.120 | 0.480 | 500.000 | 499.615 | 0.230 | 500.000 | 499.869 | 0.068 | 500.000 | 499.940 | 0.020 | 500.000 | 499.960 | 0.000 |

All dimensions are in millimeters.
Preferred fits for other sizes can be calculated from data given in ANSI B4.2-1978 (R1984).
'All fits shown in this table have clearance.
Source: Reprinted courtesy of The American Society of Mechanical Engineers.

The hardness, specific heat, and Young's modulus of materials are also result effective parameters in the proposed invention.

LIST OF TABLES

Table-1 ANSI clearance fit dimensions

Objects and Advantages (1) The proposed invention is an improved double impact bullet.

(2) The proposed invention can be used to generate a spherical shock wave of extremely high pressure to further the damage to armor beyond what was previously possible.

(3) The proposed invention has a unique sliding internal mechanical hammer which slides with close tolerance inside the fuselage providing a concise short rise time shock wave pulse previously unachievable by any other projectile device.

DETAILED DESCRIPTION OF THE INVENTION

The invention has mechanical modes and they will be described in an order that teaches the reader the essence of the technology. In all the modes of the proposed invention it is assumed that the reader is skilled in the art and that it is obvious how to get the projectile into flight from a launching device such as an explosive gun powder or its equivalent in a firearm. The means of setting the projectile in motion is a launching device. It is also assumed that a full metal copper jacket would cover each of the structures shown in all of the modes of the invention. The full metal copper jacket is left out of the description and is absent from the drawings. Terminology from rocketry science is used since it seems like the terms are a natural way to describe the technology. These terms are specific to the proposed invention and their meanings are not identical to the way they are used in rocketry but they are however close. For example, a nose cone in rocketry is a separate and distinct embodiment from the fuselage but for the proposed invention they may be considered a single embodiment depending on whether they are made of different materials.

Figure 1:
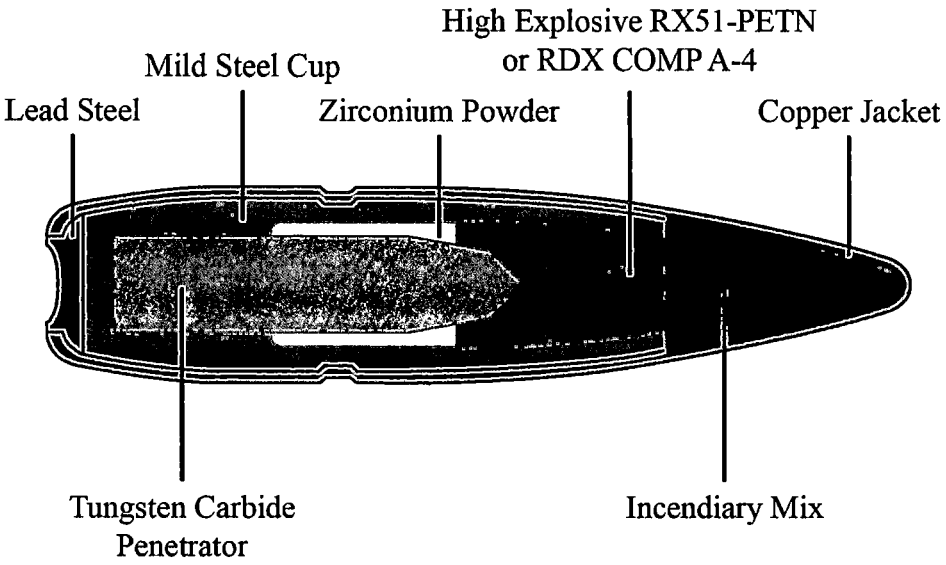
FIG.-1 (PRIOR ART)
FIG. 1 Modern exploding bullet design with penetrator
Figure 2:
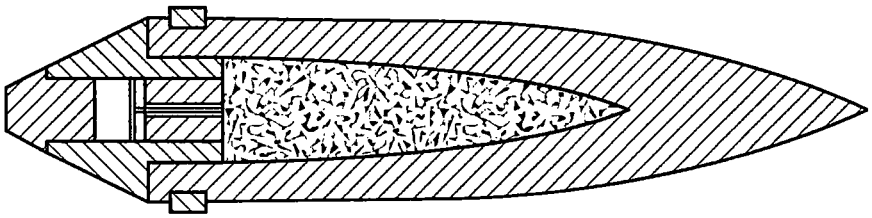
FIG.-2 (PRIOR ART)
FIG. 2 Exploding bullet of Holblad from 1900
Figure 3:
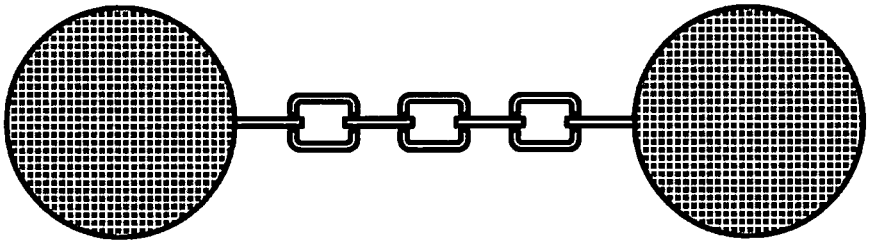
FIG.-3 (PRIOR ART)
FIG. 3 Tethered musket balls for double impact
Figure 4:
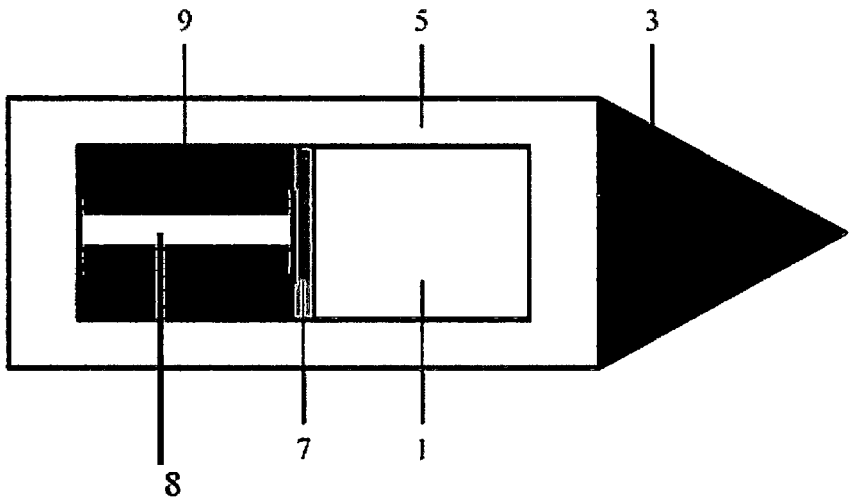
FIG. 4 Basic Design with internal hammer and post and pointed nose cone

Referring to FIG. 4 what is shown are the basic embodiments of the first mode of the proposed invention. It consists of an empty internal space (1), a nose cone (3), a fuselage (5), a Hammer retaining mass spacer (7), an internal Hammer (9), an internal post (8), and said hammer being cylindrical and having a hole therethrough its coaxial center and occupying said hole is an internal post (8) on which said hammer can slide back and forth. The hammer is inherently internal and will be referred to as the hammer without further use of the adjective internal. The operation of the first mode comprises the following. After the bullet is in flight it will fly towards its target. Upon impact with the target the nose cone and fuselage will experience a shock wave of first mechanical impact. Due to the deceleration of the center of mass of the system the hammer will be forced forward towards the nose cone. As the hammer is forced forward the hammer retaining spacer is designed to break and allow the hammer to move forward within the fuselage. Alternatively, the hammer could be tethered to the rear of the fuselage. The tether would be a string which would break upon impact as the hammer is forced forward. The nose cone can be made large enough and massive enough to allow the hammer enough time to move through the fuselage before the fuselage suffered fracture which would immobilize the hammer. Thus upon first impact the nose cone would be designed to undergo a plastic deformation that would absorb the initial shock wave thereby protecting the fuselage from damage giving the hammer enough time to move through the interior of the fuselage. The hammer would thus be forced through the nose cone and into the target providing a secondary impact to the target. It is desirable that the hammer have as mass as large as possible and still allow the bullet to fly without tumbling in the air due to hydrodynamic chaos. One means to achieve this end is to have the nose cone made from lead. The fuselage would be made from ceramic. The hammer would be made from Lead, Uranium, Tungsten, Gold, Platinum, Mercury, Iridium or other high-density alloys. Depleted uranium would be fine since there is no advantage to it being not depleted. These choices of materials would allow the bullet to function upon impact. The desired mechanical effects are that the initial blow causes plastic deformation in the nose cone. The first shock wave is thus slowed down by the plastic deformation. The hammer is forced forward in the rigid structure of the fuselage. The hammer makes the secondary impact with the target. The first mode of the proposed invention is thus a double impact bullet. The first impact serves to soften the target by way of kinetic energy being converted into heat. The second impact of the hammer serves to deliver the penetrating blow to the target. The hammer itself is a solid cylinder with a hole through its center and coaxial with the cylindrical hammer axis. The hammer like all cylinders it has a length and a diameter. The diameter of the hole is much less than the outer diameter of the hammer as shown in FIG. 4. The hammer has specific mechanical communication with the fuselage and post in that the hammer slides past and along the two surfaces those two surfaces being the post and the inner wall of the fuselage. The length of the hammer is an important parameter and such we shall refer to its length at times as $L_H$. The L indicating length and the subscript H indicating hammer. The fuselage is also a cylinder. It is different from the hammer in that it is not a solid cylinder with a hole. The fuselage is a hollow cylinder or a solid cylinder with a large enough hole for the hammer to slide therethrough. Therefore it has walls with a defined thickness. The perpendicular cross section of all hollow cylinders defines two concentric circles. The inner circle has a diameter which we shall refer to as the inner diameter. The outer circle has a diameter which we shall refer to as the outer diameter. The wall thickness of all hollow cylinders is one half of the outer diameter minus one half of the inner diameter. The fuselage in this invention is indeed a hollow cylinder and it has a length. The length of the fuselage is an important parameter and such we shall refer to its length at times as ($L_F$). The L indicating length and the subscript F indicating fuselage. Furthermore, the fuselage is a hollow cylinder and so has an inner diameter and an outer diameter. In describing this invention and in the language of the claims we may refer to as the inner diameter of the fuselage as (ID) and the outer diameter of the fuselage as (OD). Since the hammer has to slide within said fuselage and the fuselage has closed ends it is obvious by conservation of space that the length of the hammer must be less than the length of said fuselage inner length. In the notation now defined this can also be worded with phrases like "the hammer having a length less than ($L_F$)" which will have the meaning that the length of the hammer is less than the length of the fuselage as it must be if it is to be able to move within the hollow enclosure defined by the fuselage which is a hollow cylinder. It should also be noted that the hammer will slide within the fuselage and so must have a diameter that is less than the (ID) of the fuselage. How much less is determined by the standard machining practices as defined in the machining handbooks. For the purposes of the invention the diameter of the hammer should be between one and 10 mils less than the inner diameter of the fuselage in which it slides. A mil being a thousandth of an inch. The exact ansi dimensions are shown in table-1. Referring to table-1 a loose running clearance fit is the ideal tolerance to be used. The retaining spacer can be absent since upon acceleration of the bullet from the barrel the hammer is forced to the rear of the fuselage. With no retaining spacer as the bullet slows in flight the hammer can start to drift forward. For close range the retaining spacer can be absent with almost no loss of function. Again the hammer has a hole coincidental and parallel to its cylinder axis and said hammer rides on the internal post which occupies said hole. The diameter of said hole is greater than the diameter of said post so the hammer is free to slide on said post.

Figure 5:
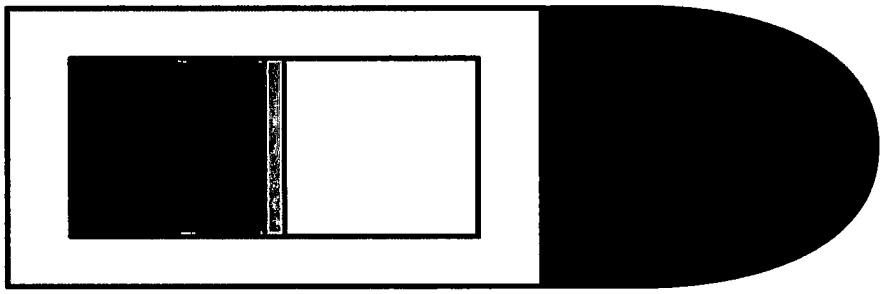
FIG. 5 Basic Design with internal hammer and round nose cone. The post is not shown.

Referring to FIG. 5 what is shown is another version of the first mode of the invention with all the same basic elements as those found in FIG. 4. The only difference is that there is a geometric difference in the design of the nose cone. Thus, all the adjustments in shape that are made in bullets in general can be made to the bullet projectiles of the proposed invention. The post is not shown in FIG. 5 but it is understood to be there.

In one mode of the proposed invention the hammer is Uranium. The nose cone can be made of lead which has a relatively low specific heat. The nose cone made of lead gets relatively hot on impact and deforms around the sides of the fuselage. This will spread kinetic energy around the fuselage and protect it from getting damaged so there is time for the hammer to move inside the fuselage and deliver the secondary impact.

Heat will raise the temperature of the nose cone and deform it around the fuselage. A choice of materials for the fuselage is ceramic or a very stiff metal like spring steel. The nose cone should be made of copper or lead. The Hammer should be made of Uranium or Tungsten or any other high-density metal or alloy.

In another mode of the proposed invention the nose cone and hammer have the same mass and are made of tungsten along with the fuselage being made of tungsten.

In another mode of the proposed invention the nose cone has 3/2 the mass of the hammer or just simply a larger mass than the hammer. This allows for stability in flight.

In another mode of the proposed invention the fuselage is made of a polymer.

In another mode of the proposed invention the Young's modulus of the fuselage and hammer are greater than the Young's modulus of said nose cone.

In another mode of the proposed invention the specific heat of the nose cone is greater than the specific heat of the hammer.

In another mode of the proposed invention the specific heat of the hardness of the hammer is higher than the nose cone.

CONCLUSIONS RAMIFICATIONS AND SCOPE

The above disclosed is a bullet system which in its mechanical mode is simply a double impact bullet with an internal Hammer mechanism. The invention is broad with many more permutations than have been discussed and is not to be judged on the specification but rather on the scope of the claims that follow.

What is claimed is:

1. A non-explosive projectile, comprising:

A rear end and a front end, a closed hollow cylindrical fuselage having a fuselage inner diameter, a fuselage outer diameter, an internal fuselage length, and an external fuselage length extending from the rear end toward the front end, a nose cone having a tip and a base, the tip provided at the front end and extending toward the rear end with the base, the base of the nose cone fixed to the closed hollow cylindrical fuselage, a solid cylindrical hammer having a hammer length being less than the internal fuselage length, a hammer diameter being less than the fuselage inner diameter, the hammer being positioned within the closed hollow cylindrical fuselage, said hammer having a central hole through which extends a rigid post, and said post having a diameter less than the diameter of said hole, and said post being affixed to the internal structure of said fuselage and said post extending the length of said internal fuselage, and said post being positioned coincident along the coaxial center of said fuselage a gap between the end of the closed hollow internal cylindrical fuselage and the hammer, and the hammer configured to slide within the closed hollow internal cylindrical fuselage during acceleration and deceleration of the projectile, and said hammer configured to slide on said post.

2. The projectile of claim 1, wherein said hammer is composed of a material selected from the group consisting of lead, uranium, tungsten, gold, platinum, mercury, or iridium.

3. The projectile of claim 1, wherein said fuselage is composed of ceramic.

4. The projectile of claim 1, wherein said fuselage is composed of a polymer material.

5. The projectile of claim 1, wherein said nose cone is rounded.

6. The projectile of claiin 1, further comprising a retaining structure within the closed hollow cylindrical fuselage, the retaining structure being a wall or ridge adjacent to the hammer to retain the hammer prior to impact.

7. The projectile of claim 1 wherein said hammer is composed of lead, said fuselage is composed of ceramic, and said nose cone is composed of copper.

8. The projectile of claim 1, wherein said nose cone is pointed.

9. The projectile of claim 1, wherein said nose cone and said hammer have the same mass.

10. The projectile of claim 1, wherein said nose cone and said hammer are composed of the same material.

11. The projectile of claim 1, wherein said nose cone has a mass greater than the mass of said hammer.

12. The projectile of claim 1, wherein the fit between said post and said hammer is a loose running clearance fit.

13. The projectile of claim 1, wherein the fit between the inner diameter of said fuselage and the outer diameter of said hammer is a loose running clearance fit.

14. The projectile of claim 1, wherein the Young's modulus of said hammer is greater than the Young's modulus of said nose cone.

15. The projectile of claim 1, wherein the specific heat of said hammer is less than the specific heat of said nose cone.

16. The projectile of claim 1, wherein the hardness of said hammer is greater than the hardness of said nose cone.

* * * * *